United States Patent [19]

Roy

[11] Patent Number: 4,685,268

[45] Date of Patent: Aug. 11, 1987

[54] METHOD AND APPARATUS FOR REINFORCING BUILDING BRICK VENEER FOOTINGS

[76] Inventor: Roger E. Roy, 11601 W. River Rd., Champlin, Minn. 55316

[21] Appl. No.: 870,367

[22] Filed: Jun. 4, 1986

Related U.S. Application Data

[63] Continuation-in-part of Ser. No. 727,750, Apr. 26, 1985, abandoned.

[51] Int. Cl.[4] ..... E02D 19/00

[52] U.S. Cl. ..... 52/742; 52/714; 52/294; 52/169.1

[58] Field of Search ..... 52/293, 294, 295, 742, 52/714, 702, 703; 248/247, 214, 220.2, 222.2

[56] References Cited

U.S. PATENT DOCUMENTS

| | | | |
|---|---|---|---|
| 798,683 | 9/1905 | Ketteman | 248/247 |
| 1,068,391 | 7/1913 | Jensen | 248/214 |
| 1,803,141 | 4/1931 | Paulissen | 52/714 |
| 1,857,926 | 5/1932 | Mason | 52/293 |
| 2,081,380 | 5/1937 | Nachreiner | 52/293 |
| 3,017,155 | 1/1962 | Scarpetti | 248/235 |
| 3,313,509 | 4/1967 | Lockert | 248/247 |
| 3,347,510 | 10/1967 | Bayken | 248/247 |
| 4,155,461 | 5/1979 | Young | 248/220.2 |
| 4,584,813 | 4/1986 | Hudson | 248/214 |

FOREIGN PATENT DOCUMENTS

| | | | |
|---|---|---|---|
| 2222425 | 11/1973 | Fed. Rep. of Germany | 52/714 |
| 566891 | 1/1945 | United Kingdom | 248/247 |

*Primary Examiner*—Henry E. Raduazo

*Attorney, Agent, or Firm*—Lawrence M. Nawrocki

[57] ABSTRACT

A method employing a support bracket (38) to strengthen the footing (30) which undergirds a brick veneer (8) to be applied to a building. A trench (32) is excavated adjacent the foundational wall (14) of the building being constructed, and brackets (38) are anchored to the wall (14). With the brackets (38) in place, concrete is poured into the trench (32) to form the footing (30).

5 Claims, 4 Drawing Figures

METHOD AND APPARATUS FOR REINFORCING BUILDING BRICK VENEER FOOTINGS

CROSS-REFERENCE TO RELATED APPLICATION

This application is a continuation-in-part of applicant's co-pending application, Ser. No. 727,750 Filed Apr. 26, 1985, now abandoned.

TECHNICAL FIELD

The present invention is related broadly to the field of building construction. More narrowly, however, it relates to methods for supporting brick veneers applied to the front of structures. Specifically, the invention deals with apparatus for strengthening concrete footings for supporting brick veneers applied to the outside vertical walls of buildings, and methods employing such implements.

BACKGROUND OF THE INVENTION

Depending upon the climate in which a building is constructed, the particular materials employed in constructing the building vary. While in some climatic conditions wood would be appropriate, other conditions might dictate that stucco or brick be used.

The appearance of brick is particularly desirable in the construction of residential buildings. Construction of brick homes is on the upswing in view of the ever-increasing fashionability of such dwellings. Such is the case regardless of the climatic conditions of any particular area, although brick homes would tend to have a greater functionality in areas where winters tend to be cold.

In building a brick home, a foundation, typically utilizing large concrete blocks, is first laid. The walls of the building are, in turn, framed and erected on the foundational blocks. The framing is, typically, flush with the outwardly facing surfaces of the foundational blocks.

A brick veneer is, in turn, erected over the framing on what is to be the outside of the building. Because of the weight of the veneer, a support footing is provided, and the veneer is built up on top of the footing. Typically, such a footing is made of poured concrete.

Present methodology for supporting such brick veneers envisions one of a number of processes. A first method (and one which is generally impracticable) consists of digging all the way down to the footing of the foundation and pouring concrete to that depth. Such a method tends to be impracticable for a number of reasons, but it is particularly inapplicable when the building being constructed is a rambler home. With such structures, digging to a depth of eight feet or more would be required. Not only would digging to such a depth involve significant time and effort, but it would also require the pouring of large volumes of concrete.

A second method known in the prior art includes providing a plurality of cantilevered iron rods which are made to extend perpendicularly from the foundation wall (that is, generally horizontally) at depths slightly below the surface of the ground. Concrete is, in turn, poured to encase the rod extensions. Such a method is somewhat improved over the previously discussed method, and the improvement would provide some strength to the brick veneer footing.

For a number of reasons, however, problems remain when this method is practiced. For example, the method presents difficulties as far as anchoring the cantilevered rods. Additionally, because of the length of the rods, fitting of the rods relative to the foundational blocks can pose problems.

Even when such a method is practiced, the support provided by the rods is, in some respects, limited. The strength rendered to the footing by the rods is a function of how adequately the rods are anchored. Even when the rods are securely anchored, however, there is give in the rods as a result of their having some measure of resiliency. When significant loads are placed on the footing, the rods can bend and the adequacy of the footing be diminished.

An additional problem encountered when pouring such concrete footings is the deterioration of structural components because of frost in the ground. If the frost conditions are severe, major structural impairment can occur.

It is to these problems in the prior art that the invention of the present document is directed. It not only provides a footing strengthening method and apparatus which are more effective to support the significant weights of brick veneers, but it also functions to deflect frost rising within the ground outwardly and upwardly away from the foundation of the building.

SUMMARY OF THE INVENTION

The present invention includes an apparatus for reinforcing a concrete footing for a brick veneer as discussed above, such veneers to be applied to the outside vertical walls of a structure being built. The apparatus is a support bracket which includes a hook portion for attachment to the foundation blocks at a location proximate the lower edge of the framing. The hook portion includes a leg which can be inserted through an aperture broken through an outwardly facing surface of the foundation blocks. A shoulder, intersecting the leg of the hook portion, is, when the leg is inserted through the aperture, seated on a lowermost portion of the periphery of the aperture broken through the concrete foundation block. With the shoulder so seated, the leg of the hook portion would tend to orient itself generally vertically. The bracket further includes a support portion, integrally formed with the hook portion, functioning, when the hook portion cooperates with the aperture in the foundation block, to engage the outwardly facing surface of the foundational wall to brace the bracket. The footing formed by pouring concrete around a plurality of the brackets in a relatively shallow trench dug adjacent the foundation to receive the footing is, thereby, strengthened.

The present invention further comprises a method of strengthening footings which support brick veneers as discussed previously. The method can include the digging of a trench at the surface of the ground and adjacent the foundation blocks comprising the foundation of the building. The trench would extend a sufficient vertical distance to allow mounting of a plurality of brackets, as previously discussed, at a short distance below the frame footing. The trench would extend upwardly and outwardly in a sloping fashion around the foundation of the structure. A plurality of support brackets would be provided at appropriate, predetermined intervals to adequately support a brick veneer footing formed when concrete is subsequently poured in the trench. The brackets could be mounted to the foundation by punching holes in the foundation blocks at the appropriate intervals and inserting the hook portion of a bracket in each of the apertures.

A bracket could also be mounted as the foundation blocks are being laid. The bracket hook portion would then be mounted extending over the top of a block and into a hollow space of the foundation block, and the support portion, when the invention is practiced in this manner, would be held in place between the foundation block into which the bracket is hooked and that immediately below.

In either manner of practicing the invention, with the brackets securely attached to the foundation, concrete would be poured into the trench to encase the brackets. A polystyrene form placed around in-place brackets could be used to define the space into which concrete is to be poured.

In practicing a preferred embodiment of the method invention, a horizontally disposed reinforcement rod or rebar could be positioned within perimeters defined by the brackets to provide additional strength against shearing forces along an axis parallel to the foundational wall. This reinforcing rod could be wire-tied to the brackets and, if a plurality of rebars are employed, at predetermined distances apart on the inside of the angled portion of the brackets. As can be seen then, the present invention is an improved apparatus and method for strengthening concrete brick veneer footings. Additional features and advantages obtained in view of those features will become apparent with reference to the DETAILED DESCRIPTION OF THE INVENTION, appended claims, and accompanying drawing

DETAILED DESCRIPTION OF THE INVENTION

Figure 1:
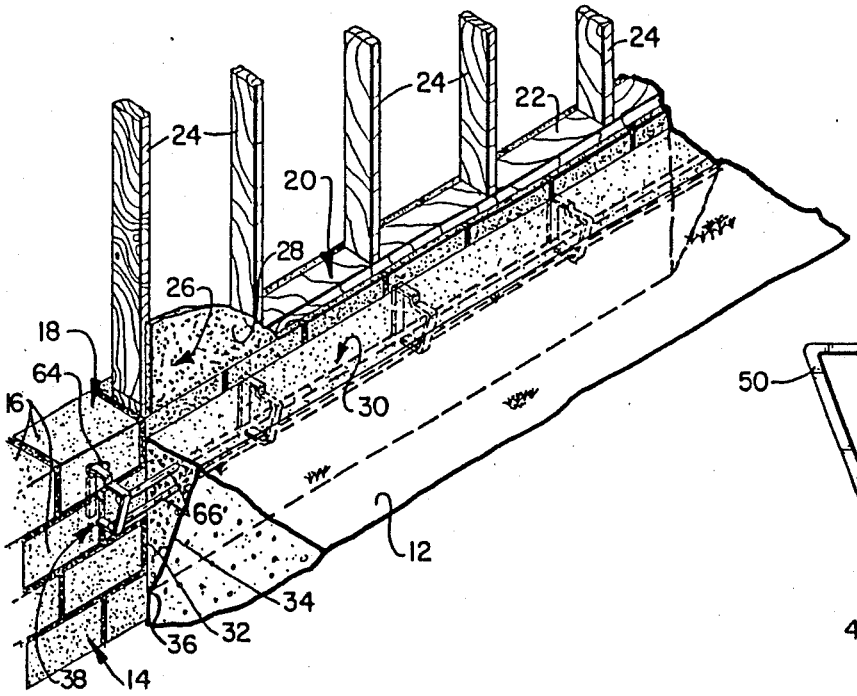
FIG. 1 is a perspective view of a segment of a building foundation with the framing of the building seated thereon, wherein a brick veneer footing constructed in accordance with the present invention is illustrated.
Figure 2:
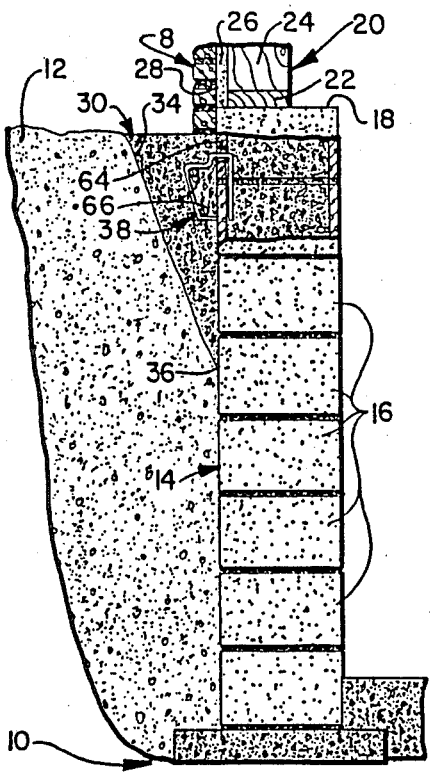
FIG. 2 is a side sectional view of the footing illustrated in FIG. 1.

Referring now to the drawing wherein like reference numerals denote like elements throughout the several views, FIG. 1 illustrates a portion of the structure of a building being constructed to have a brick veneer 8 facing outwardly. FIG. 2 illustrates a foundation footing 10 which is laid at an appropriate depth below ground level 12. A foundational wall 14 is constructed on top of the foundation footing 10 and is built up, as illustrated in the figures, to slightly above the ground level 12. The foundational wall 14 is formed from a multiplicity of concrete blocks 16 which are laid in an appropriate masonry pattern. Concrete blocks 16 typically used in the construction of foundations are hollow, being formed with hollow spaces defined therewithin, and it is contemplated that the present invention would be used in conjunction with such blocks 16.

An upper surface 18 of the foundational wall 14, in turn supports a wooden frame 20 constructed of appropriately sized boards. A typical frame 20 includes a footing 22, extending generally horizontally on top of the foundational wall 14, and a multiplicity of generally vertically disposed studs 24 spaced at lateral distances from one another. What is an outer side of the frame 20 can be overlain with sheeting 26 which can incorporate insulative properties to function to retain heat either inside or outside the structure, depending upon the season. Typically, such sheeting 26 would have an outwardly facing surface 28 flush with the outwardly facing surface of the foundational wall 14.

The manner of constructing a building as defined to this point is well known in the art. The present invention, however, relates to methods and apparatus for supporting a brick veneer 8 to be applied to the outer side of the building's frame 20.

Because of the weight of such veneers 8, a special footing 30 needs to be laid in order to support the veneer 8. In order to minimize the difficulty and expense in laying such a footing 30, a trench 32 is dug to a relatively shallow depth along the foundational wall 14, and the trench 32 is provided with a side 34 which slopes upwardly and outwardly from the deepest part 36 of the trench 32. In cross section, therefore, the trench is basically triangular.

The footing is ultimately formed by pouring concrete into the trench 32 and filling the trench to where the concrete is substantially at the ground level 12. It will be understood, however, that, should it be desirable to minimize the amount of concrete to be used in forming the footing 30, the concrete can be poured to a point at which it does not completely fill the trench 32.

Because of the relative shallowness of the trench 32, and the commensurate relatively small size of the footing 30, such a footing 30 might not adequately provide the strength necessary to support the veneer 8 to be placed thereon. The present invention, therefore, envisions strengthening the footing by having placed a plurality of support brackets 38 in the trench 32 prior to filling it with concrete and anchoring those support brackets 38 to the foundational wall 14.

Figure 3:
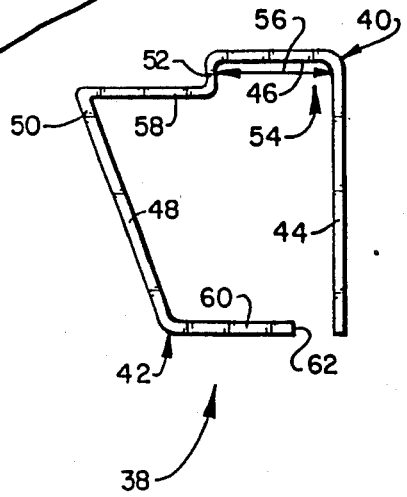
FIG. 3 is a side elevational view of a support bracket in with the invention.

FIG. 3 illustrates a support bracket 38 in accordance with the preferred embodiment of the invention. The bracket 38 includes a hook portion 40 and a support portion 42. The hook portion 40 includes a leg 44 which, when the bracket 38 is anchored to the foundational wall 14 in a manner to be discussed hereinafter, is disposed generally vertically. The hook portion 40 also includes a shoulder 46 which, although not essential to the invention, is shown as intersecting the leg 44 of the hook portion 40 generally perpendicularly. It will be seen, therefore, that, when the bracket 38 is anchored to the foundational wall 14 for its intended purpose, the shoulder 46 will be generally horizontal.

The support portion 42 can be formed integrally with the hook portion 40, and it is envisioned that the support bracket 38 would be formed from a metal strap angled in a fashion to form the bracket 38 in a desired configuration. The support portion 42 includes a first length 48 shown as forming an acute angle to the leg 44 of the hook portion 42. A first end 50 of the support portion first length 48 is connected to the shoulder 46 of the hook portion 40 by appropriate members. A short interconnecting member 52 is shown as being generally parallel to the leg 44 of the hook portion 40 to define a channel 54 substantially the length of the shoulder 46. This channel 54 can be made so that it has a width, as illustrated at 56, similar to the thickness of a wall of a concrete block 16 to which the bracket 38 will eventually be mounted. A longer interconnecting member 58 is shown as extending generally perpendicular to the leg 44 of the hook portion 40, and the longer member 58 intersects the shorter member 52 and the first end 50 of the support portion first length 48.

FIG. 3 illustrates a second, wall engaging length 60 extending from the end of the first length 48 opposite that by which it is attached to the shoulder 46. The second, wall engaging length 60 of the support portion 42 is shown as being generally perpendicular to the leg 44 of the hook portion 40, although such a construction is not exclusive. A distal end 62 of the second length 60, in any case, is spaced at a sufficient distance from the hook portion leg 44 so that the thickness of a concrete foundation block wall can be received therebetween.

Referring now to FIGS. 1 and 2, in constructing the footing 30 for the brick veneer 8, the mason would dig a trench 32 to a depth of approximately three foundation blocks 16. It is believed that a concrete footing poured to that depth is adequate, in view of the support brackets 38, to provide sufficient strength to the veneer 8. The side 34 of the trench 32 angles upwardly and away from the foundational wall 14 to define an acute angle. Although not essential to the invention, this side 34 can be dug at an angle approximating the angle at which the first length 48 of a support portion 42 of a bracket 38 would be disposed once the bracket 38 is anchored to the foundational wall 14. By digging the trench 32 with a side 34 so angling, frost and moisture rising in the ground toward the ground level 12 would be deflected away from the foundation wall 14.

With a depth of three foundation blocks thus exposed, apertures 64 can be punched out, in the uppermost row of blocks 16 if desired, in the outwardly facing surfaces of those blocks 16. The apertures 64 can be made at intervals small enough so that sufficient strength will be imparted to the footing 30 by the support brackets 38. Since building codes of many cities require that, when cantilevered rods as known in the prior art are used as supports, they be spaced at distances of no greater than 32 inches, such spacing could appropriately be adopted for the spacing of the present support brackets 38. It is believed, however, because of the strength of the present brackets 38 over that of cantilevered rods, spacing could be made at greater intervals.

With apertures 64 so punched out of the outwardly facing surfaces of the foundation blocks 16, a support bracket 38 can be anchored in each of the apertures 64. The leg 44 of the hook portion 40 can be inserted through the aperture 64 and the bracket 38 rotated so that the shoulder 46 of the hook portion 40 is seated on the lowermost portion of the periphery of the aperture 64. Because the distance between the short interconnecting member 52 and the leg 44 of the hook portion 40 approximates the thickness of the block outwardly facing wall, movement of the bracket 38 toward and away from the foundation will be limited. The sizing of the channel 54 will, additionally, function to dispose the leg 44 of the hook portion 40 generally vertically.

The support portion 42, if necessary, can be pulled back as the leg 44 of the hook portion 40 is inserted into the aperture 64. When the bracket 38 is in position, the support portion 42 can be released. Release of the support portion 42 will allow the distal end 62 of the support portion length 60 to engage the outwardly facing surface of the foundation blocks 16. The support portion 42 of the bracket 38 will, thereby, function to revector the forces exerted upon the veneer footing 30 by the bricks supported thereby in a direction toward the foundational wall 14 rather than parallel thereto.

Once the series of support brackets 38 are in place with their shoulders 46 seated on the lowermost portions of their respective apertures 64, concrete can be poured into the trench 32 and allowed to harden. As the concrete is poured into the trench 32, it can be allowed to flow into apertures 64. As it hardens, therefore, it not only forms the footing 30, but it also serves to anchor the footing 30 and the brackets 38 to the foundational wall 14. The footing 30 thereby formed will provide improved strength over footings constructed in manners known in the art.

A second embodiment of the invention envisions placing the support bracket 38 into position as the concrete blocks 16 are being laid. In this embodiment, the leg 44 of the support bracket 38 is inserted into a hollow space formed within the concrete block during its manufacture, with the wall engaging length 60 being placed between the concrete block 16 into which leg 44 is hooked and that immediately below. Concrete can then be poured into the hollow concrete block 16 and into the trench 32 to anchor the bracket 38 and form the footing 30.

A polystyrene form can be utilized to define the trench side wall 34 and contain the concrete poured therein.

Figure 4:
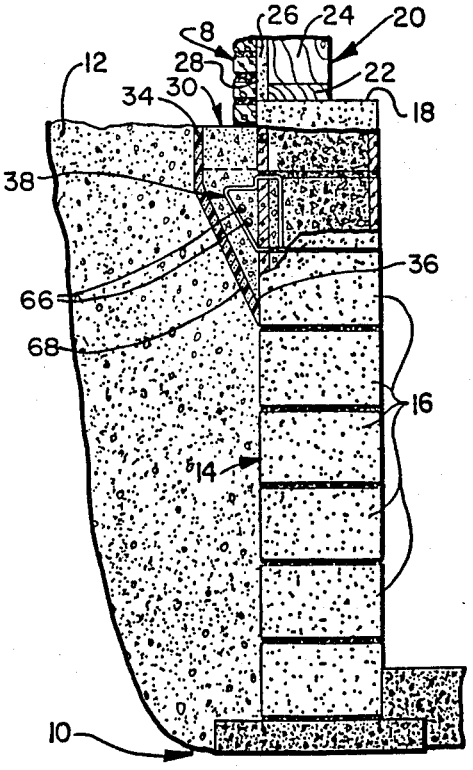
FIG. 4 is a side sectional view of an alternative embodiment of the invention.

If it is desired to impart to the footing 30 additional strength against shearing forces exerted along an axis parallel to the base of the foundation, a length or lengths of rebar 66 can be secured to the brackets 38 about their peripheries. Although two rebars 66 are shown in FIGS. 1, 2, and 4 as being secured at locations within the peripheries of the brackets 38 and at opposite ends of the support portion first length 48, it will be understood that other manners of positioning these rebars 66 are contemplated as being within the scope of the invention. For example, a rebar 66 might be placed on top of the bracket 38 at the intersection of the short and long interconnecting members 52, 58.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A method of reinforcing a concrete footing for brick veneer to be applied to the outside vertical wall of a structure, comprising the steps, performed prior to the pouring of the concrete footing, of:

(a) providing a support bracket including:

(i) a hook portion having a shoulder and a leg generally perpendicular to the shoulder; and (ii) a support portion formed integrally with the hook portion and having a first length forming an acute angle with the leg of the hook portion and a second, wall engaging length extending from the first length of the support portion and disposed generally perpendicular to the leg of the hook portion, a distal end of the wall engaging length being spaced from the leg of the hook portion;

(b) mounting a support bracket so provided to a foundation of which a foundation wall is constructed by inserting the leg of the hook portion of the support bracket through a hollow space formed within a foundation block and sliding the bracket downwardly to engage the shoulder of the hook portion with a periphery of the hollow space through which the leg of the hook portion has been inserted; and (c) sliding the distal end of the wall engaging length of the support portion of the bracket beneath an underside of the foundation block to which the bracket is being mounted.

2. A method in accordance with claim 1 comprising the additional step of digging an upwardly and outwardly sloping trench, in which the bracket will be recessed, adjacent the outside vertical wall of the structure prior to performing steps (a)–(c) of claim 1.

3. A method in accordance with claim 2 comprising the additional step of pouring concrete into the trench to encase the bracket after performing steps (a)–(c) of claim 1.

4. A method wherein a plurality of brackets are employed to reinforce a concrete footing in accordance with claim 1.

5. A method in accordance with claim 4 wherein each of the brackets defines a plane generally perpendicular to the outside vertical wall of the structure to which it is secured, said method further comprising a step of disposing at least one rebar along the wall and passing the rebar within perimeters defined by the brackets, and generally perpendicular to planes defind by the brackets.

* * * * *